US008823271B2

(12) United States Patent
van de Ven et al.

(10) Patent No.: US 8,823,271 B2
(45) Date of Patent: Sep. 2, 2014

(54) SOLID-STATE LIGHTING APPARATUS INCLUDING AN ENERGY STORAGE MODULE FOR APPLYING POWER TO A LIGHT SOURCE ELEMENT DURING LOW POWER INTERVALS AND METHODS OF OPERATING THE SAME

(75) Inventors: Antony P. van de Ven, Sai Kung (HK); Liqin Ni, Morrisville, NC (US)

(73) Assignee: Cree, Inc., Durham, NC (US)

( * ) Notice: Subject to any disclaimer, the term of this patent is extended or adjusted under 35 U.S.C. 154(b) by 328 days.

(21) Appl. No.: 13/338,095

(22) Filed: Dec. 27, 2011

(65) Prior Publication Data

US 2013/0162149 A1 Jun. 27, 2013

(51) Int. Cl.
*H05B 41/00* (2006.01)

(52) U.S. Cl.
USPC ..... 315/188; 315/185 R; 315/291; 315/312; 315/360

(58) Field of Classification Search
CPC .. H05B 41/232; H05B 41/32; H05B 41/2928; H05B 33/0824; H05B 33/0833; H05B 33/0803; H05B 33/0815; H05B 33/0818; H05B 37/029
USPC ..... 315/186, 188, 193, 121, 122, 185 R, 315/224, 246, 291, 294, 297, 307, 308, 312, 315/360; 345/82, 94, 102, 204, 212
See application file for complete search history.

(56) References Cited

U.S. PATENT DOCUMENTS

| | | | | |
|---|---|---|---|---|
| 5,941,626 | A | 8/1999 | Yamuro | |
| 8,179,704 | B2 * | 5/2012 | Wang et al. | 363/52 |
| 8,324,840 | B2 * | 12/2012 | Shteynberg et al. | 315/308 |
| 8,330,390 | B2 * | 12/2012 | Hum et al. | 315/294 |
| 8,344,659 | B2 * | 1/2013 | Shimomura et al. | 315/307 |
| 8,373,363 | B2 * | 2/2013 | Grajcar | 315/307 |
| 8,410,717 | B2 * | 4/2013 | Shteynberg et al. | 315/291 |
| 8,476,836 | B2 * | 7/2013 | van De Ven et al. | 315/193 |
| 2004/0046510 | A1 | 3/2004 | Allen | |
| 2004/0206970 | A1 | 10/2004 | Martin | |
| 2006/0232219 | A1 | 10/2006 | Xu | |
| 2008/0018261 | A1 * | 1/2008 | Kastner | 315/192 |
| 2008/0116818 | A1 | 5/2008 | Shteynberg et al. | |
| 2010/0308738 | A1 | 12/2010 | Shteynberg et al. | |
| 2010/0308739 | A1 | 12/2010 | Shteynberg et al. | |
| 2011/0115412 | A1 | 5/2011 | Welten | |
| 2011/0227484 | A1 | 9/2011 | Huynh | |
| 2011/0234110 | A1 | 9/2011 | Liu et al. | |
| 2012/0091920 | A1 | 4/2012 | Yang | |
| 2012/0099321 | A1 | 4/2012 | Scott et al. | |

(Continued)

OTHER PUBLICATIONS

International Search Report Corresponding to International Application No. PCT/US12/71151; Date of Mailing: Mar. 7, 2013; 10 Pages.

*Primary Examiner* — Haiss Philogene
(74) *Attorney, Agent, or Firm* — Myers Bigel Sibley & Sajovec, PA

(57) ABSTRACT

A lighting apparatus includes a string of Light Emitting Diode (LED) sets coupled in series, each set including at least one LED, a light spreading circuit configured to incrementally turn on respective ones of the LED sets responsive to a power signal, and an energy storage module that is configured to store energy during a first interval of a period of the power signal and to apply the stored energy to the string during a second interval of the period of the power signal.

31 Claims, 13 Drawing Sheets

(56) References Cited

U.S. PATENT DOCUMENTS

2013/0069535 A1* 3/2013 Athalye ..... 315/121
2013/0069536 A1* 3/2013 Ni ..... 315/122
2013/0069547 A1* 3/2013 van de Ven et al. ..... 315/188
2013/0162153 A1* 6/2013 van de Ven et al. ..... 315/193

* cited by examiner

SOLID-STATE LIGHTING APPARATUS INCLUDING AN ENERGY STORAGE MODULE FOR APPLYING POWER TO A LIGHT SOURCE ELEMENT DURING LOW POWER INTERVALS AND METHODS OF OPERATING THE SAME

FIELD

The present inventive subject matter relates to lighting apparatus and methods and, more particularly, to solid-state lighting apparatus and methods.

BACKGROUND

Solid-state lighting arrays are used for a number of lighting applications. For example, solid-state lighting panels including arrays of solid-state light emitting devices have been used as direct illumination sources, for example, in architectural and/or accent lighting. A solid-state light emitting device may include, for example, a packaged light emitting device including one or more light emitting diodes (LEDs), which may include inorganic LEDs, which may include semiconductor layers forming p-n junctions and/or organic LEDs (OLEDs), which may include organic light emission layers.

Solid-state lighting arrays are used for a number of lighting applications. For example, solid-state lighting panels including arrays of solid-state light emitting devices have been used as direct illumination sources, for example, in architectural and/or accent lighting. Solid-state lighting devices are also used in lighting fixtures, such as incandescent bulb replacement applications, task lighting, recessed light fixtures and the like. For example, Cree, Inc. produces a variety of recessed downlights, such as the LR-6 and CR-6, which use LEDs for illumination. Solid-state lighting panels are also commonly used as backlights for small liquid crystal display (LCD) screens, such as LCD display screens used in portable electronic devices, and for larger displays, such as LCD television displays.

A solid-state light emitting device may include, for example, a packaged light emitting device including one or more LEDs. Inorganic LEDs typically include semiconductor layers forming p-n junctions. Organic LEDs (OLEDs), which include organic light emission layers, are another type of solid-state light emitting device. Typically, a solid-state light emitting device generates light through the recombination of electronic carriers, i.e. electrons and holes, in a light emitting layer or region.

Some attempts at providing solid-state lighting sources have involved driving an LED or string or group of LEDs using a rectified alternating current (ac) waveform. However, because the LEDs require a minimum forward voltage to turn on, the LEDs may turn on for only a part of the rectified ac waveform, which may result in visible flickering, may undesirably lower the power factor of the system, and/or may increase resistive loss in the system. Examples of techniques for driving LEDs with a rectified ac waveform are described in U.S. Patent Application Publication No. 2010/0308738 and in copending U.S. patent application Ser. No. 12/777,842, the latter of which is commonly assigned to the assignee of the present application.

Other attempts at providing ac-driven solid-state lighting sources have involved placing LEDs in an anti-parallel configuration, so that half of the LEDs are driven on each half-cycle of an ac waveform. However, this approach requires twice as many LEDs to produce the same luminous flux as using a rectified ac signal.

SUMMARY

According to some embodiments of the inventive subject matter, a lighting apparatus includes a string of LED sets coupled in series, each set including at least one LED, a light spreading circuit configured to incrementally turn on respective ones of the LED sets responsive to a power signal, and an energy storage module that is configured to store energy during a first interval of a period of the power signal and to apply the stored energy to the string during a second interval of the period of the power signal.

In other embodiments, the energy storage module is further configured to divert current from the string to a charge storage element during the first interval.

In still other embodiments, the energy storage module comprises a notch circuit that is coupled to a node of the string and is configured to electrically disconnect the string from the power signal responsive to a voltage of the power signal exceeding a threshold, such as, for example, a summation of forward bias voltages of the respective LED sets and breakdown voltages of a pair of control Zener diodes.

In still other embodiments, the energy storage module comprises a fill circuit that is configured to electrically couple the charge storage element to the string responsive to a voltage of the power signal falling below a threshold, such as, for example, a breakdown voltage of a control Zener diode.

In still other embodiments, the power signal has a peak voltage value during the first interval.

In still other embodiments, the power signal has its lowest voltage value during the second interval.

In still other embodiments, a voltage value of the power signal is greater during the first interval than the voltage value of the power signal during the second interval.

In still other embodiments, the first interval and the second interval have approximately a same duration.

In still other embodiments, all of the LED sets in the string are turned on during the second interval.

In still other embodiments, a current signal through the string has a dominant frequency component that has a higher frequency value than a frequency value of a dominant frequency of the power signal.

In still other embodiments, the frequency value of the dominant frequency component of the current signal through the string is at least three times the frequency value of the dominant frequency of the power signal.

In still other embodiments, the lighting apparatus further includes a rectifier circuit configured to be coupled to an ac power source to generate the power signal.

In further embodiments of the inventive subject matter, a lighting apparatus includes a light source element and an energy storage module that is configured to electrically disconnect the light source element from a power signal during a first interval of a period of the power signal to store energy and to apply the stored energy to the light source element during a second interval of the period of the power signal.

In still further embodiments, the power signal has a peak voltage value during the first interval.

In still further embodiments, the power signal has its lowest voltage value during the second interval.

In still further embodiments, a voltage value of the power signal is greater during the first interval than the voltage value of the power signal during the second interval.

In still further embodiments, the first interval and the second interval have approximately a same duration.

In still further embodiments, a current signal through the light source element has a dominant frequency component that has a higher frequency value than a frequency value of a dominant frequency of the power signal.

In still further embodiments, the frequency value of the dominant frequency component of the current signal through the light source element is at least three times the frequency value of the dominant frequency of the power signal.

In still further embodiments, the lighting apparatus further includes a rectifier circuit configured to be coupled to an ac power source to generate the power signal.

In still further embodiments, the light source element comprises an LED.

In still further embodiments, the light source element comprises a string of LED sets coupled in series, each set including at least one LED.

In other embodiments of the inventive subject matter, a lighting apparatus is operated by electrically disconnecting a light source element from a power signal during a first interval of a period of the power signal to store energy and applying the stored energy to the light source element during a second interval of the period of the power signal.

In still other embodiments, the power signal has a peak voltage value during the first interval.

In still other embodiments, the power signal has its lowest voltage value during the second interval.

In still other embodiments, a current signal through the light source element has a dominant frequency component that has a higher frequency value than a frequency value of a dominant frequency of the power signal.

In still other embodiments, the frequency value of the dominant frequency component of the current signal through the light source element is at least three times the frequency value of the dominant frequency of the power signal.

In still other embodiments, the light source element comprises a LED.

In still other embodiments, the light source element comprises a string of LED sets coupled in series, each set including at least one LED.

BRIEF DESCRIPTION OF THE DRAWINGS

The accompanying drawings, which are included to provide a further understanding of the inventive subject matter and are incorporated in and constitute a part of this application, illustrate certain embodiment(s) of the inventive subject matter. In the drawings.

DETAILED DESCRIPTION

Figure 1:
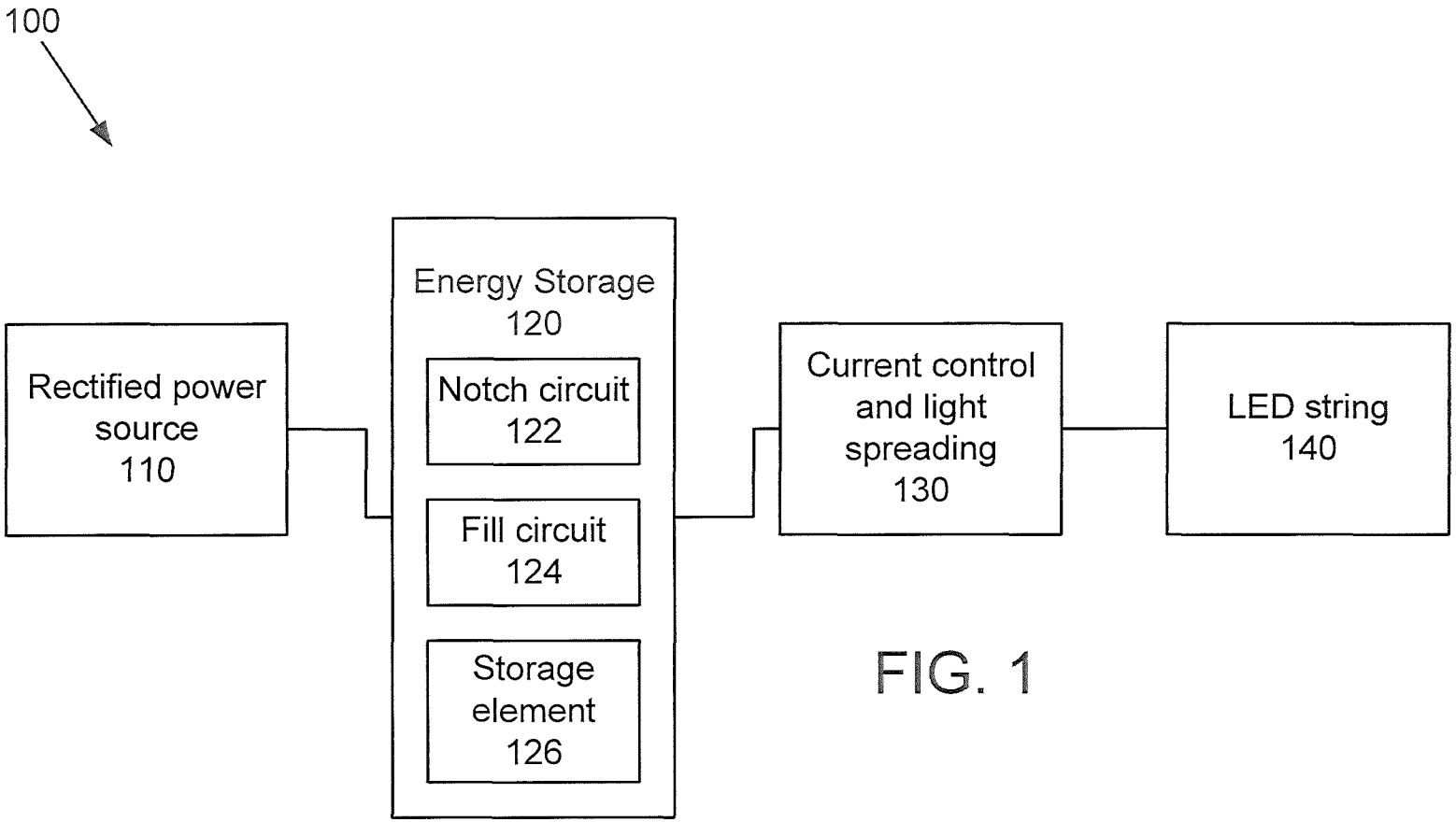
FIG. 1 illustrates a lighting apparatus according to some embodiments of the inventive subject matter.

Embodiments of the present inventive subject matter now will be described more fully hereinafter with reference to the accompanying drawings, in which embodiments of the inventive subject matter are shown. This inventive subject matter may, however, be embodied in many different forms and should not be construed as limited to the embodiments set forth herein. Rather, these embodiments are provided so that this disclosure will be thorough and complete, and will fully convey the scope of the inventive subject matter to those skilled in the art. Like numbers refer to like elements throughout the description. Each embodiment described herein also includes its complementary conductivity embodiment.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive subject matter. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It will be understood that when an element or layer is referred to as being "on" another element or layer, the element or layer can be directly on another element or layer or intervening elements or layers may also be present. In contrast, when an element is referred to as being "directly on" another element or layer, there are no intervening elements or layers present. As used herein, the term "and/or" includes any and all combinations of one or more of the associated listed items.

Spatially relative terms, such as "below", "beneath", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation, in addition to the orientation depicted in the figures. Throughout the specification, like reference numerals in the drawings denote like elements.

Embodiments of the inventive subject matter are described herein with reference to plan and perspective illustrations that are schematic illustrations of idealized embodiments of the inventive subject matter. As such, variations from the shapes of the illustrations as a result, for example, of manufacturing techniques and/or tolerances, are to be expected. Thus, the inventive subject matter should not be construed as limited to the particular shapes of objects illustrated herein, but should include deviations in shapes that result, for example, from manufacturing. Thus, the objects illustrated in the figures are schematic in nature and their shapes are not intended to illustrate the actual shape of a region of a device and are not intended to limit the scope of the inventive subject matter.

The terminology used herein is for the purpose of describing particular embodiments only and is not intended to be limiting of the present inventive subject matter. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present inventive subject matter belongs. It will be further understood that terms used herein should be interpreted as having a meaning that is consistent with their meaning in the context of this specification and the relevant art and will not be interpreted in an idealized or overly formal sense unless expressly so defined herein. The term "plurality" is used herein to refer to two or more of the referenced item.

The expression "lighting apparatus," as used herein, is not limited, except that it indicates that the device is capable of emitting light. That is, a lighting apparatus can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing ac incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting, work lights, etc., mirrors/vanity lighting, or any other light emitting device.

The present inventive subject matter further relates to an illuminated enclosure (the volume of which can be illuminated uniformly or non-uniformly), comprising an enclosed space and at least one lighting apparatus according to the present inventive subject matter, wherein the lighting apparatus illuminates at least a portion of the enclosed space (uniformly or non-uniformly).

According to some embodiments of the inventive subject matter, a light spreading circuit can be configured to incrementally activate and deactivate respective ones of a plurality of LED sets coupled in series to form a string. An energy storage module is configured to store energy during a first interval of a period of a power signal, such as during a peak of the power signal period, and to apply the stored energy to the string of LED sets during a second interval of the power signal period, such as during a valley portion of the power signal period. Such diversion of energy from one portion of the power signal cycle to another portion of the power signal cycle to drive the string of LED sets may provide a more uniform display of light with reduced flicker as the frequency of the current signal through the LED sets may exceed the frequency of the power signal.

FIG. 1 illustrates a lighting apparatus 100 according to some embodiments of the inventive subject matter. The apparatus 100 comprises a rectified power source 110, an energy storage module 120, a current control and light spreading module 130, and an LED string 140 that are connected as shown. The LED string 140 comprises a string of serially connected LED sets. Each of the LED sets includes at least one LED. For example, individual ones of the sets may comprise a single LED and/or individual sets may include multiple LEDs connected in various parallel and/or serial arrangements.

The current control and light spreading module 130 is used to control the activation and deactivation of the LED sets included in the LED string 140. To reduce flicker in the light output from the lighting apparatus 100, the LED sets in the LED string 140 may be incrementally activated and deactivated. Examples of current control and light spreading circuits are described, for example, in U.S. patent application Ser. No. 13/235,127 filed Sep. 16, 2011 ('127 application) and U.S. patent application Ser. No. 13/338,076, filed concurrently herewith entitled "SOLID-STATE LIGHTING APPARATUS INCLUDING CURRENT DIVERSION CONTROLLED BY LIGHTING DEVICE BIAS STATES AND CURRENT LIMITING USING A PASSIVE ELECTRICAL COMPONENT," ('076 application) both of which are hereby incorporated herein by reference in their entireties.

The energy storage module 120 may provide additional performance improvements in both reduced flicker, light color, and efficiency by storing energy from the rectified power source 110 during a first interval of the power signal period, such as during a peak of the power signal, and to apply the stored energy to the string 140 of LED sets during a second interval of the power signal period, such as during a valley portion of the power signal period. Thus, the energy storage module 120 includes a notch circuit 122 that is configured to divert current from the LED string 140 during the first interval by electrically disconnecting the LED string 140 from the rectified power source 110 and directing current to the storage element 126 by electrically coupling the storage element 126 to the rectified power source 110. This operation produces a notch in the signal representing the current passing through the LED string 140 during the first interval. The fill circuit 124 is configured to electrically couple the charge storage element 126 to the LED string 140 during the second interval. Power is provided to the LED string 140 from a rectifier circuit 110 that is configured to be coupled to an ac power source and to produce a rectified voltage and current therefrom. The rectifier circuit 110 may be included in the lighting apparatus 100 or may be part of a separate unit coupled to the apparatus 100.

Figure 2:
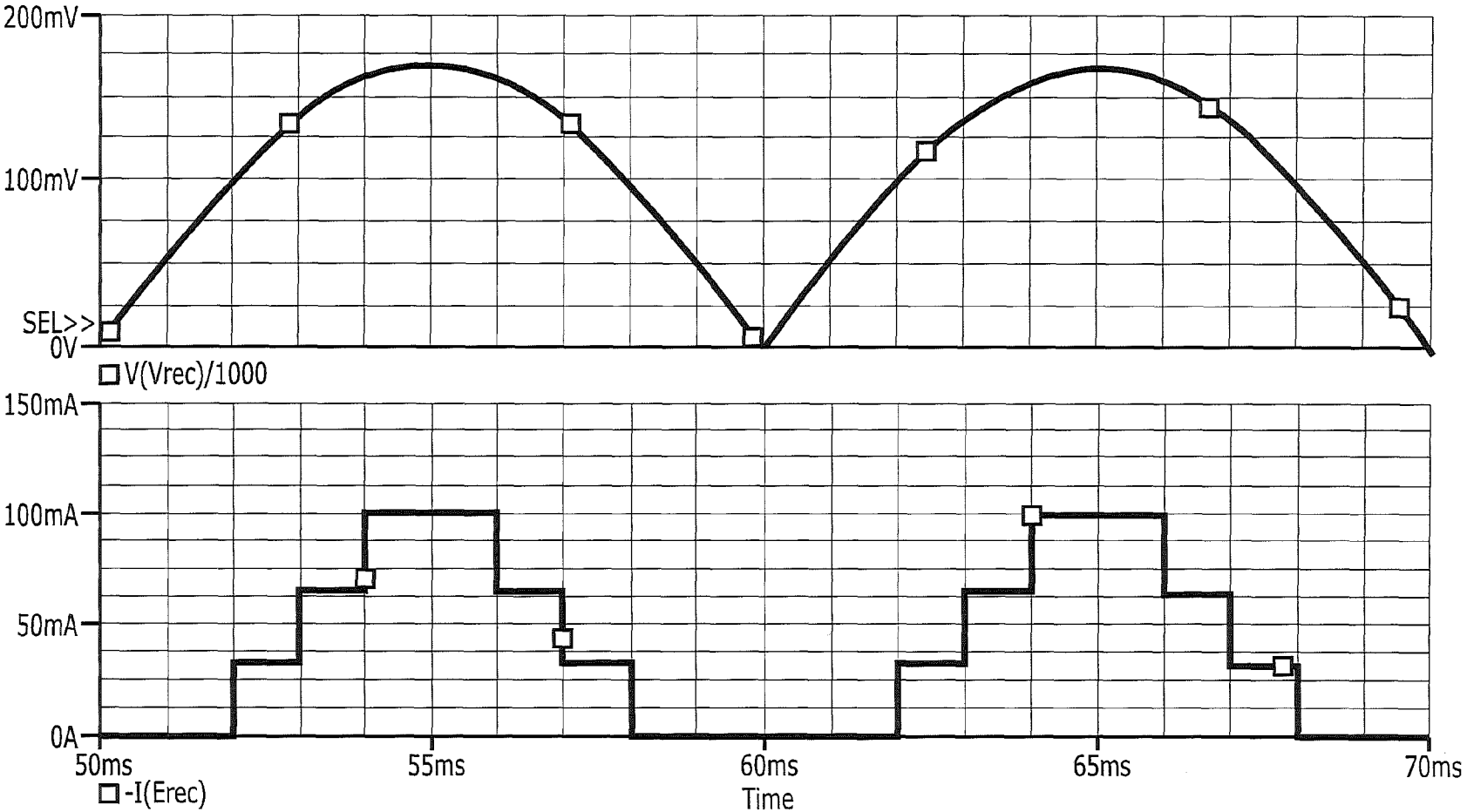
FIG. 2 is a graph of a simulation of the rectified voltage provided by the rectified power source and the current through the LED string of FIG. 1 without including the functionality of the energy storage module according to some embodiments of the inventive subject matter.

FIG. 2 is a graph of a simulation of the rectified voltage provided by the rectified power source 110 and the current through the LED string 140 without including the functionality of the energy storage module 120 according to some embodiments of the inventive subject matter. The rectified voltage is shown to have a frequency of 100 Hz and is based off of an ac power source having a frequency of 50 Hz. The LED string 140 includes three LED sets that are incrementally activated, i.e., forward biased, under the control of the current control and light spreading module 130 at times 52 ms, 53 ms, and 54 ms. Such incremental activation is described in detail in the '127 and '076 applications.

Figure 3:
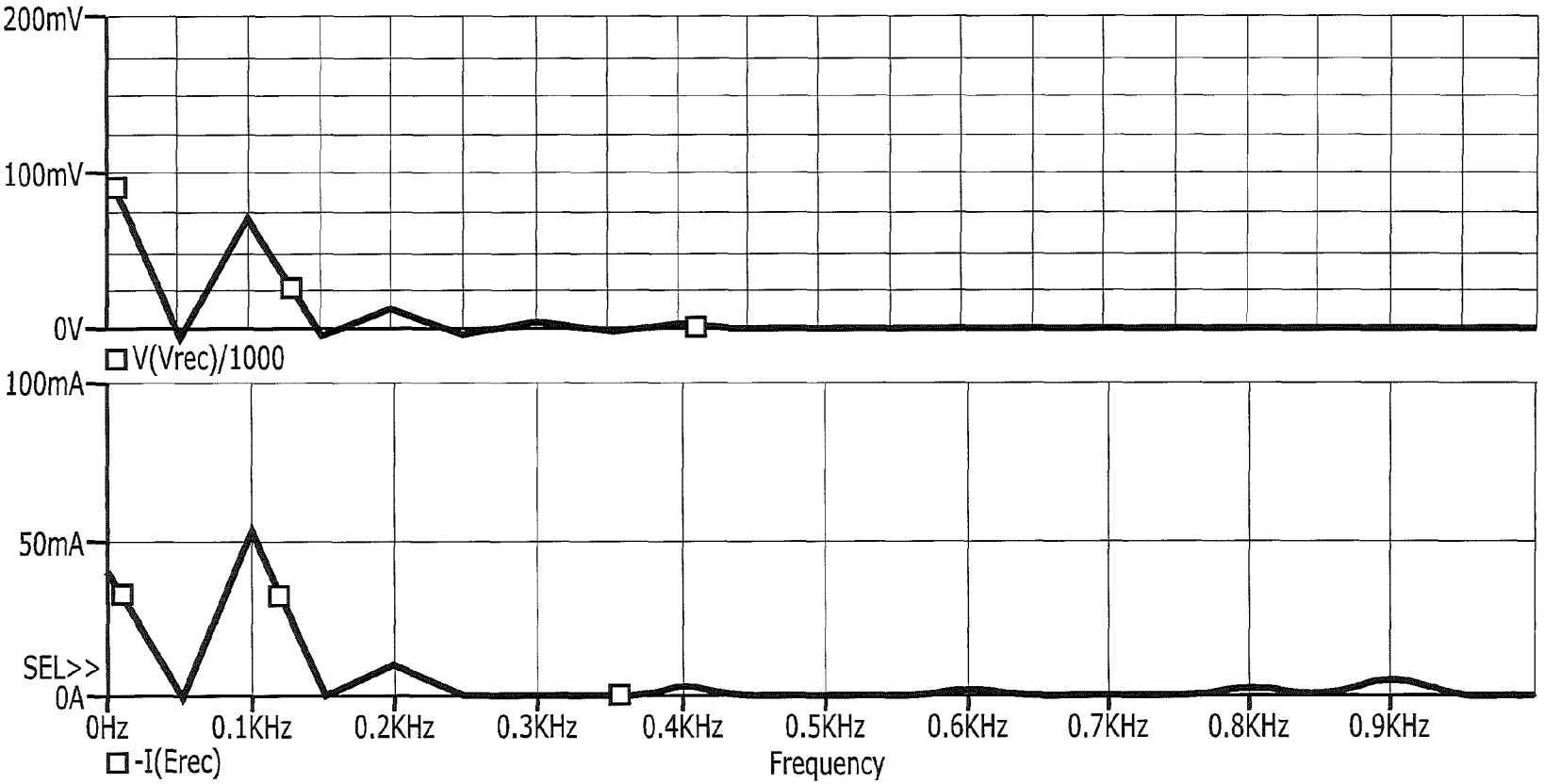
FIG. 3 illustrates a frequency domain analysis of the rectified voltage and LED string current waveforms of FIG. 2 according to some embodiments of the inventive subject matter.

FIG. 3 illustrates a frequency domain analysis of the rectified voltage and LED string 140 current waveforms of FIG. 2 according to some embodiments of the inventive subject matter. As shown in FIG. 3, the dominant frequency for both the rectified voltage and LED string 140 current is 100 Hz with higher frequency components providing much smaller contributions. The 100 Hz component in the LED string 140 current signal, however, may result in an undesirable flicker.

Figure 4:
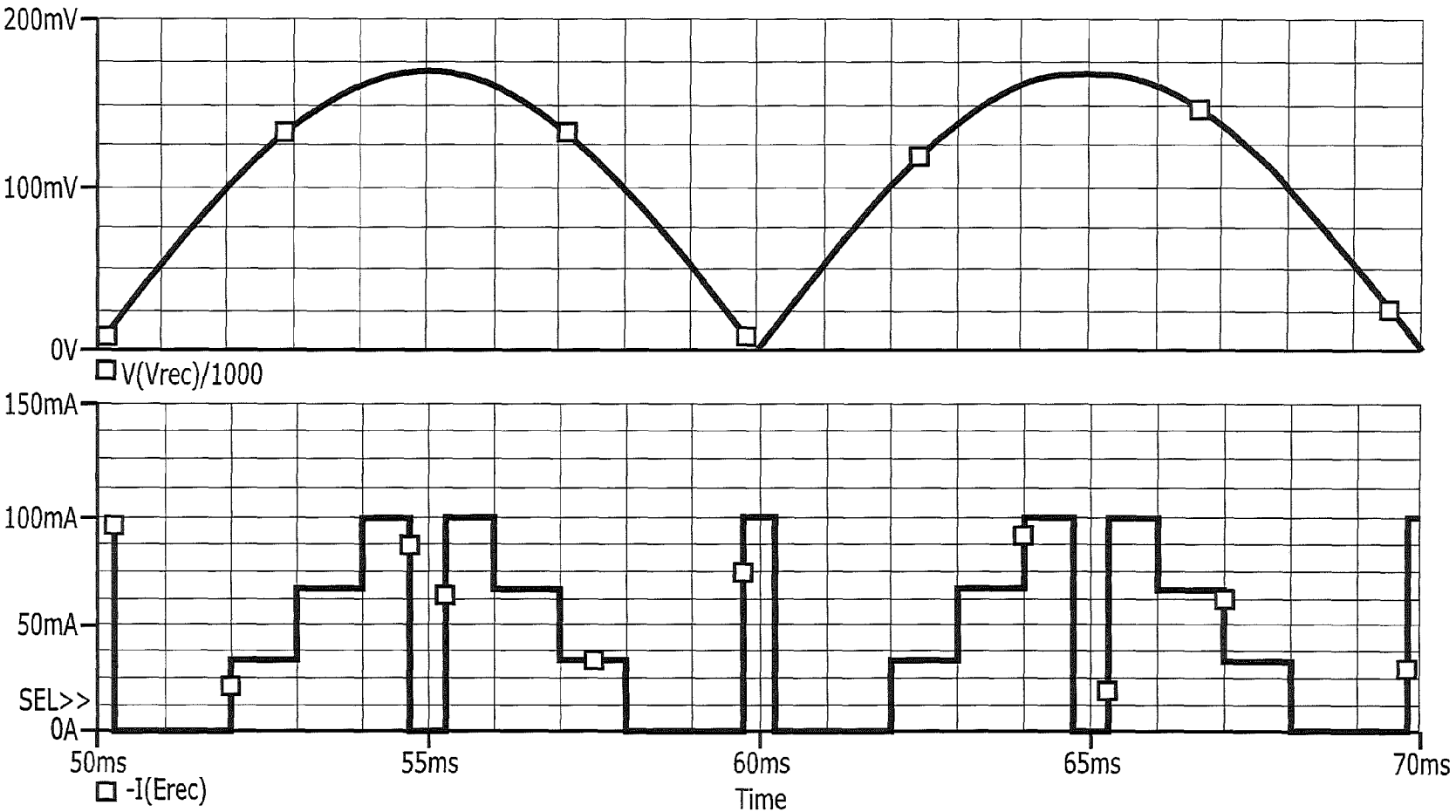
FIG. 4 is a graph of a simulation of the rectified voltage provided by the rectified power source and the current through the LED string of FIG. 1 including the functionality of the energy storage module according to some embodiments of the inventive subject matter.

FIG. 4 is a graph of a simulation of the rectified voltage provided by the rectified power source 110 and the current through the LED string 140 including the functionality of the energy storage module 120 according to some embodiments of the inventive subject matter. As shown in FIG. 4, the notch circuit 122 diverts current from the LED string 140 for a 0.5 ins interval centered around the peak of the rectified voltage provided by the rectified power source 110 at time 55 ms. In particular, the notch circuit 122 electrically disconnects the LED string 140 from the rectified voltage during the 0.5 ms interval so as to divert current away from the LED string 140 and to direct current to the storage element 126 by electrically coupling the storage element 126 to the rectified power source 110. The fill circuit 124 electrically couples the charge storage element 126 to the LED string 140 during a second interval centered around time 60 ms where the rectified voltage reaches its minimum value of zero volts. This is illustrated by the current shown flowing through the LED string 140 for a 0.5 ms interval centered around the 60 ms time point. The energy stored in the storage element 126 is sufficient to forward bias each of the LED sets in the LED string 140 when the stored energy is discharged into the LED string 140. That is, each of the LED sets in the LED string 140 is turned on during the valley portion of the rectified voltage when the LED sets are typically turned off.

Figure 5:
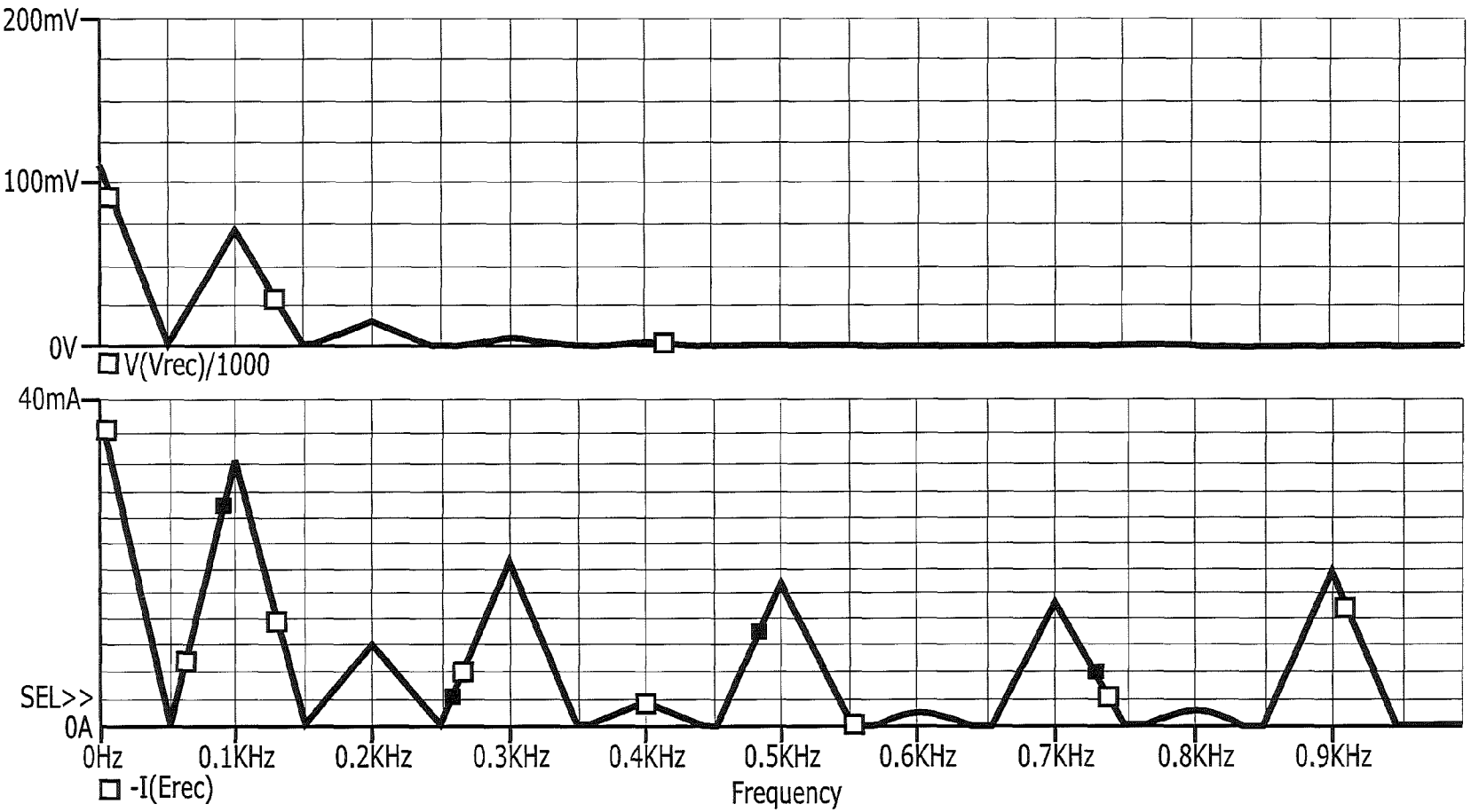
FIG. 5 illustrates a frequency domain analysis of the rectified voltage and LED string current waveforms of FIG. 4 according to some embodiments of the inventive subject matter.

FIG. 5 illustrates a frequency domain analysis of the rectified voltage and LED string 140 current waveforms of FIG. 4 according to some embodiments of the inventive subject matter. As shown in FIG. 5, the dominant frequency for the rectified voltage is 100 Hz, which is the same as that of FIG. 3. The dominant frequency for the LED string 140 current 140 is also 100 Hz, but in contrast to the simulation of FIGS. 2 and 3, the higher frequency components are no longer negligible as there are significant odd harmonics at 300 Hz, 500 Hz, 700 Hz, and 900 Hz.

Figure 6:
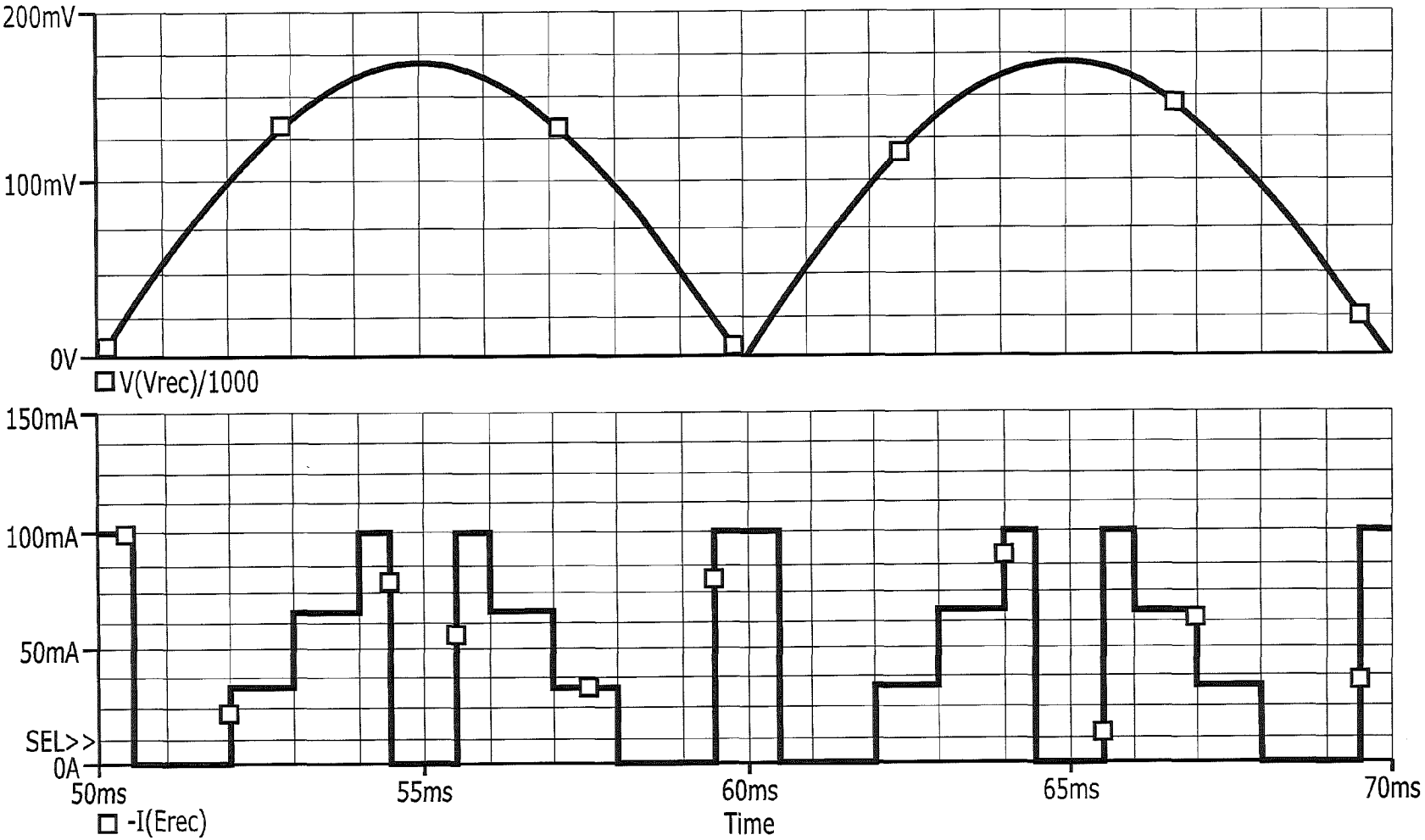
FIG. 6 is a graph of a simulation of the rectified voltage provided by the rectified power source and the current through the LED string of FIG. 1 including the functionality of the energy storage module according to further embodiments of the inventive subject matter.

FIG. 6 is a graph of a simulation of the rectified voltage provided by the rectified power source 110 and the current through the LED string 140 including the functionality of the energy storage module 120 according to some embodiments of the inventive subject matter. As shown in FIG. 6, the notch circuit 122 diverts current from the LED string 140 for a 1.0 ms interval centered around the peak of the rectified voltage provided by the rectified power source 110 at time 55 ms. In particular, the notch circuit 122 electrically disconnects the LED string 140 from the rectified voltage during the 1.0 ms interval so as to divert current away from the LED string 140 and to direct current to the storage element 126 by electrically coupling the storage element 126 to the rectified power source 110. The fill circuit 124 electrically couples the charge storage element 126 to the LED string 140 during a second interval centered around time 60 ms where the rectified voltage reaches its minimum value of zero volts. This is illustrated by the current shown flowing through the LED string 140 for a 1.0 ms interval centered around the 60 ms time point.

Figure 7:
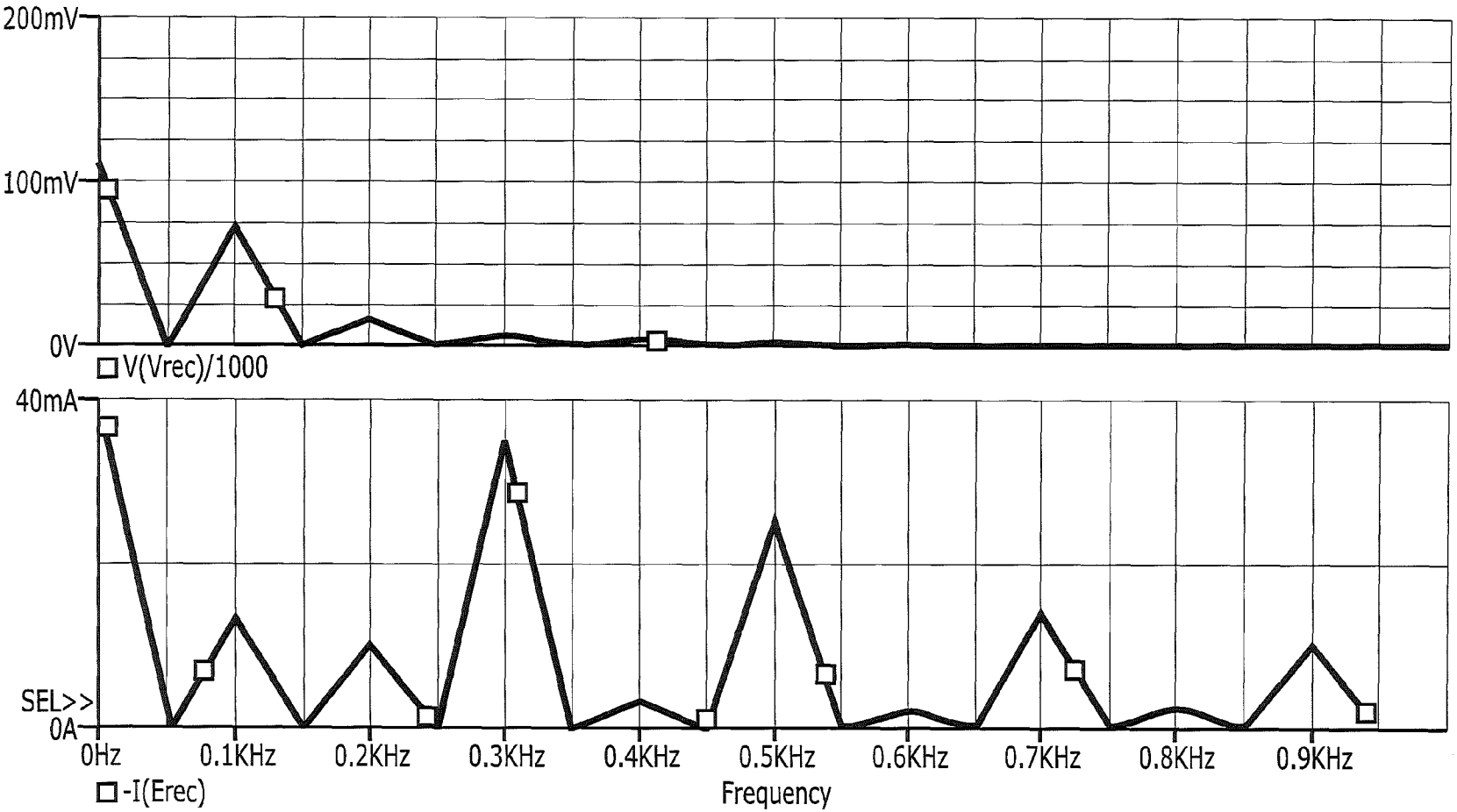
FIG. 7 illustrates a frequency domain analysis of the rectified voltage and LED string current waveforms of FIG. 6 according to some embodiments of the inventive subject matter.

FIG. 7 illustrates a frequency domain analysis of the rectified voltage and LED string 140 current waveforms of FIG. 6 according to some embodiments of the inventive subject matter. As shown in FIG. 7, the dominant frequency for the rectified voltage is 100 Hz, which is the same as that of FIGS. 3 and 5. In contrast to the simulations of FIGS. 2-5, the dominant frequency for the LED string 140 current is 300 Hz, which is three times that of the FIGS. 2 and 4 embodiments. There are also non-negligible odd harmonics at 100 Hz, 500 Hz, 700 Hz, and 900 Hz. By introducing a 1.0 ms notch in the LED string 140 current and effectively moving that notch in the current to a valley interval for the LED string 140 current, the dominant frequency for the LED string 140 current can be increased to three times that of the rectified voltage with other higher frequency harmonics also being more dominant than the dominant frequency of the rectified voltage. As a result, low frequency flicker may be reduced and the LED string may also operate at greater efficiency.

Figure 8:
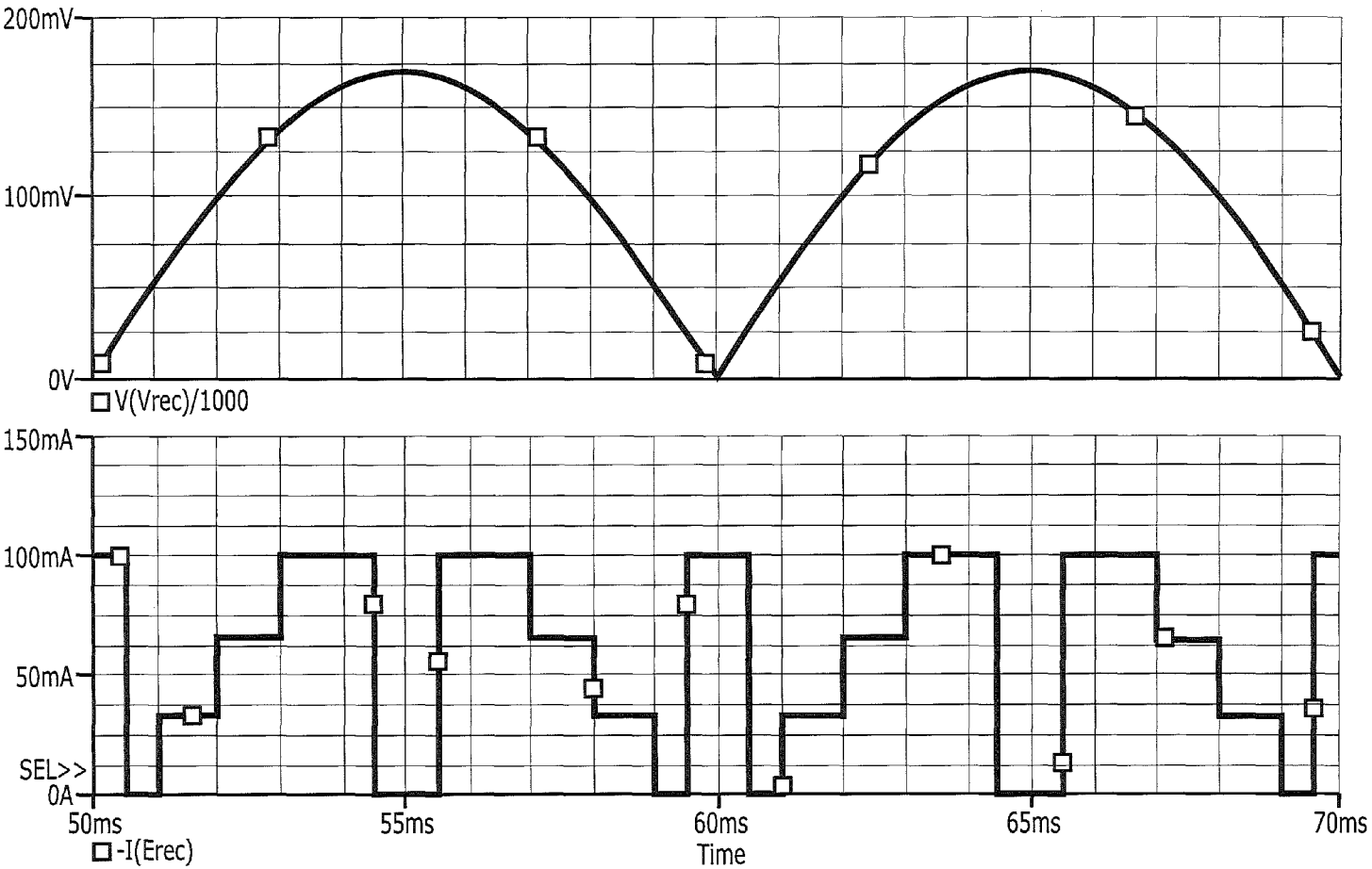
FIG. 8 is a graph of a simulation of the rectified voltage provided by the rectified power source and the current through the LED string of FIG. 1 including the functionality of the energy storage module according to further embodiments of the inventive subject matter.

FIG. 8 is a graph of a simulation of the rectified voltage provided by the rectified power source 110 and the current through the LED string 140 including the functionality of the energy storage module 120 according to some embodiments of the inventive subject matter. As shown in FIG. 8, the notch circuit 122 diverts current from the LED string 140 for a 1.0 ms interval centered around the peak of the rectified voltage provided by the rectified power source 110 at time 55 ms. In particular, the notch circuit 122 electrically disconnects the LED string 140 from the rectified voltage during the 1.0 ms interval so as to divert current away from the LED string 140 and to direct current to the storage element 126 by electrically coupling the storage element 126 to the rectified power source 110. The fill circuit 124 electrically couples the charge storage element 126 to the LED string 140 during a second interval centered around time 60 ms where the rectified voltage reaches its minimum value of zero volts. This is illustrated by the current shown flowing through the LED string 140 for a 1.0 ms interval centered around the 60 ms time point. In contrast to the simulations of FIGS. 4 and 6, however, the LED string 140 includes three LED sets that are incrementally activated under the control of the current control and light spreading module 130 one millisecond earlier at times 51 ms, 52 ms, and 53 ms with all three LED sets being active, i.e., forward biased, for 3 ms instead of 2 ms.

Figure 9:
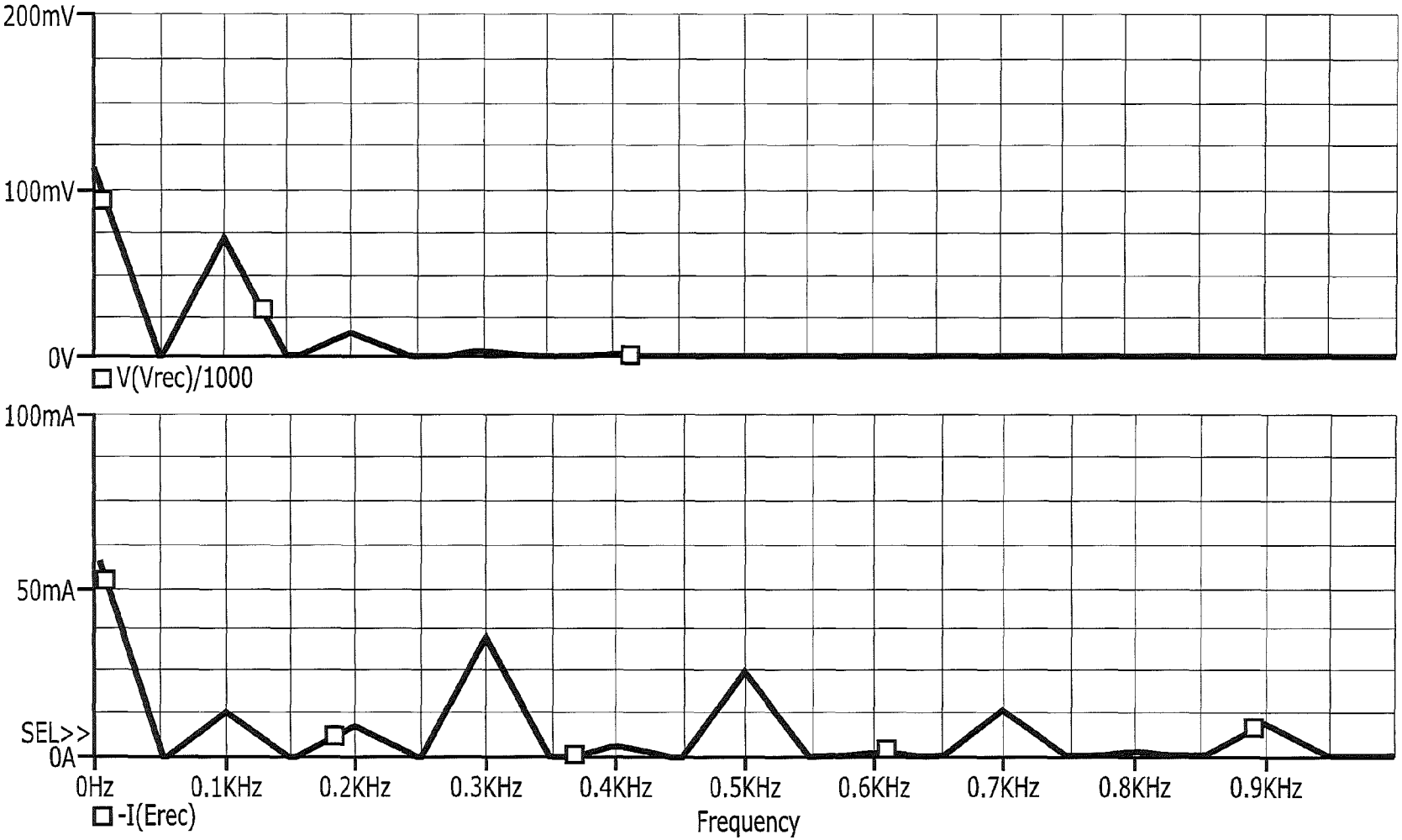
FIG. 9 illustrates a frequency domain analysis of the rectified voltage and LED string current waveforms of FIG. 8 according to some embodiments of the inventive subject matter.

FIG. 9 illustrates a frequency domain analysis of the rectified voltage and LED string 140 current waveforms of FIG.

8 according to some embodiments of the inventive subject matter. As shown in FIG. 9, the dominant frequency for the rectified voltage is 100 Hz, which is the same as that of FIGS. 3, 5, and 7. Similar to the simulation of FIGS. 6 and 7, the dominant frequency for the LED string 140 current is 300 Hz, which is three times that of the FIGS. 2 and 4 embodiments. There are also non-negligible odd harmonics at 100 Hz, 500 Hz, 700 Hz, and 900 Hz. By introducing a 1.0 ms notch in the LED string 140 current and effectively moving that notch in the current to a valley interval for the LED string 140 current, even with increased activation time for the LED string 140 sets the dominant frequency for the LED string 140 current can be increased to three times that of the rectified voltage with other higher frequency harmonics also being more dominant than the dominant frequency of the rectified voltage.

Figure 10:
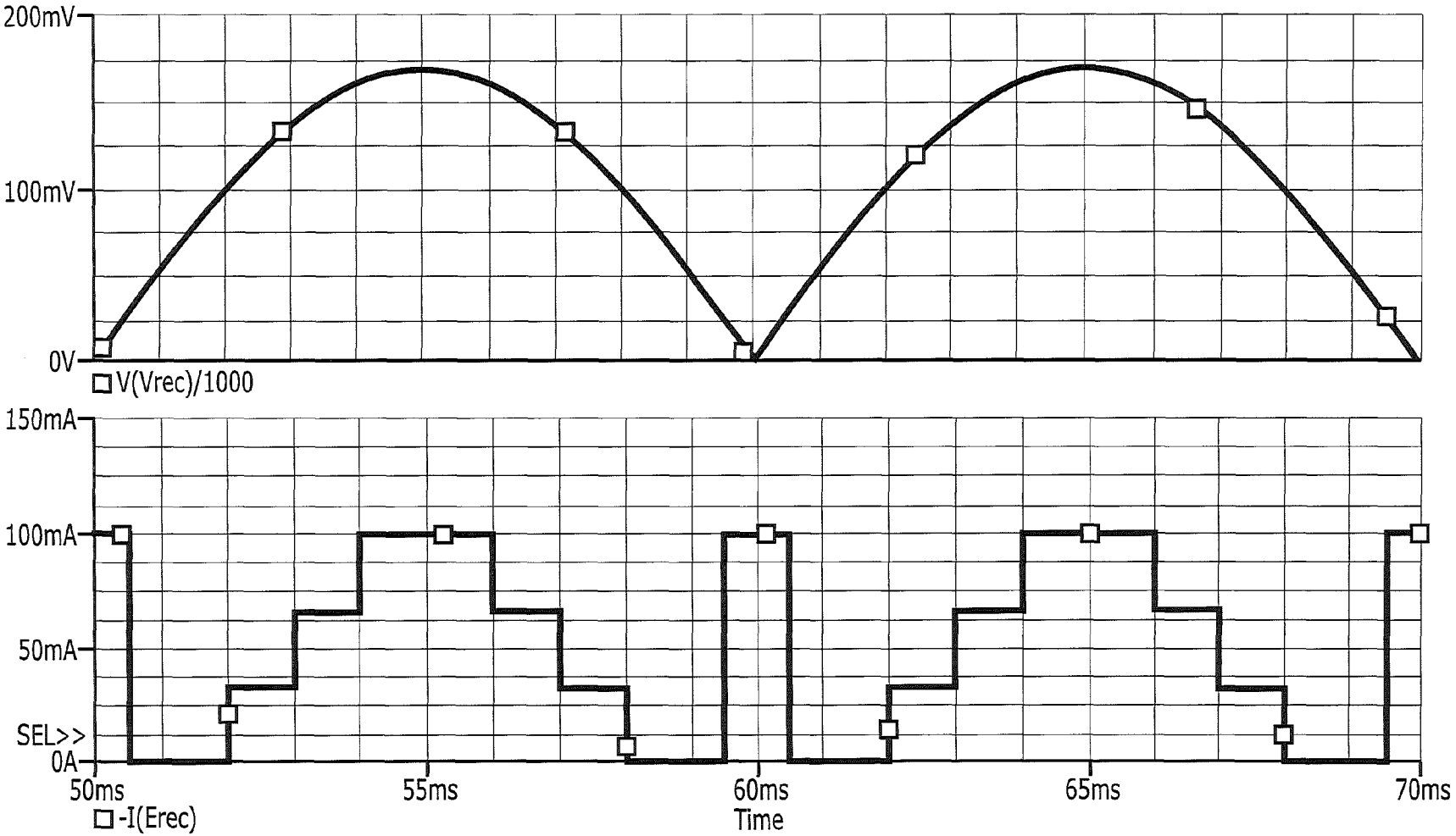
FIG. 10 is a graph of a simulation of the rectified voltage provided by the rectified power source and the current through the LED string of FIG. 1 including the functionality of the energy storage module, but in which a portion of the notch circuit functionality is not used, according to some embodiments of the inventive subject matter.

FIG. 10 is a graph of a simulation of the rectified voltage provided by the rectified power source 110 and the current through the LED string 140 including the functionality of the energy storage module 120, but in which a portion of the notch circuit 122 functionality is not used, according to some embodiments of the inventive subject matter. As shown in FIG. 10, a notch is not formed in the LED string 140 current during the 52 ms-58 ms timeframe. The notch circuit 122 does, however, couple the storage element 126 to the rectified power source 110 during the 50.5 ms-59.5 ms timeframe. The fill circuit 124 electrically couples the charge storage element 126 to the LED string 140 during a second interval centered around time 60 ms where the rectified voltage reaches its minimum value of zero volts. This is illustrated by the current shown flowing through the LED string 140 for a 1.0 ins interval centered around the 60 ms time point.

Figure 11:
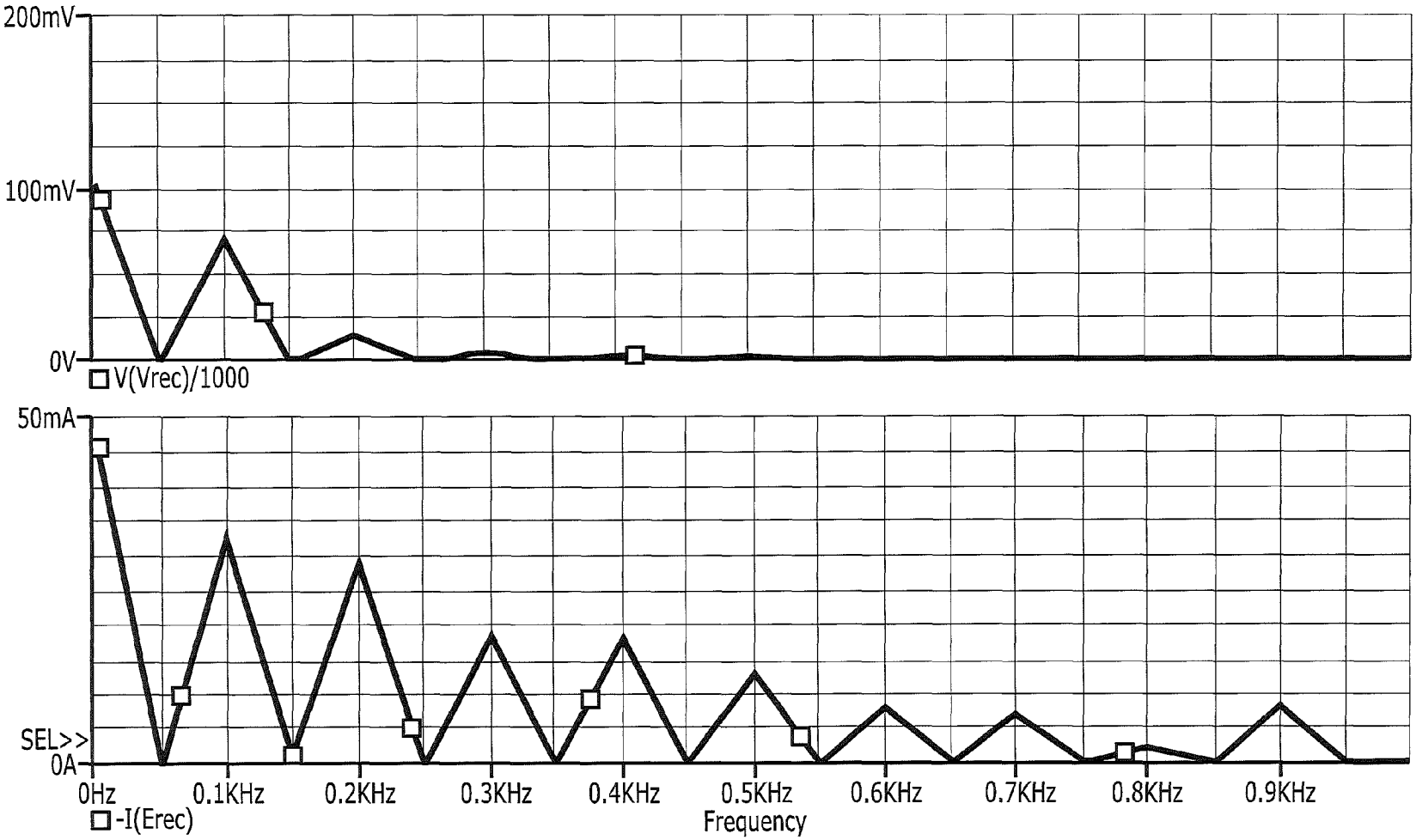
FIG. 11 illustrates a frequency domain analysis of the rectified voltage and LED string current waveforms of FIG. 10 according to some embodiments of the inventive subject matter.

FIG. 11 illustrates a frequency domain analysis of the rectified voltage and LED string 140 current waveforms of FIG. 10 according to some embodiments of the inventive subject matter. As shown in FIG. 11, the dominant frequency for the rectified voltage is 100 Hz, which is the same as that of FIGS. 3, 5, 7, and 9. The dominant frequency for the LED string 140 current is also 100 Hz with significant harmonics at 200 Hz, 300 Hz, 400 Hz, and 500 Hz. Although the dominant frequency of the LED string 140 current remains 100 Hz, the additional harmonics spaced 100 Hz apart may alleviate some of the flicker attributed to the low frequency 100 Hz component.

Figure 12:
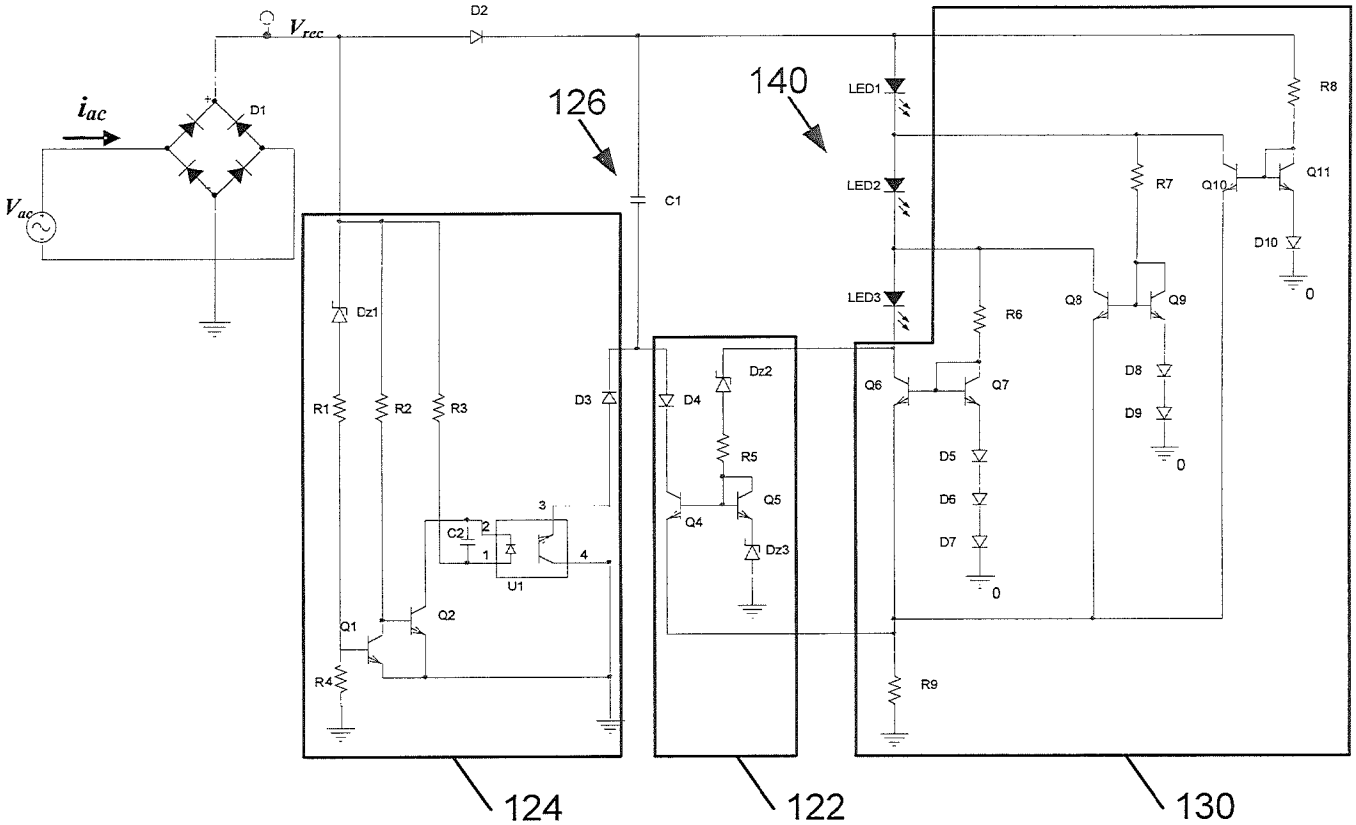
FIG. 12 is a circuit diagram that illustrates the lighting apparatus of FIG. 1 in more detail according to some embodiments of the inventive subject matter.

FIG. 12 is a circuit diagram that illustrates the lighting apparatus of FIG. 1 in more detail according to some embodiments of the inventive subject matter. The lighting apparatus is powered by an ac voltage source that is processed through a full wave rectifier circuit comprising diodes D1. The rectified voltage Vrec is used to power the lighting apparatus, which includes the energy storage module comprising a fill circuit 124 and a notch circuit 122, a current control and light spreading module 130, an LED string 140, comprising three LED sets LED1, LED2, and LED3, and a storage element 126, which comprises capacitor C1.

The current control and light spreading module 130 includes three current diverter circuits. The first current diverter circuit comprises transistors Q10 and Q11, resistor R8, and diode D10. The second current diverter circuit comprises transistors Q8 and Q9, resistor R7, and diodes D8 and D9. The third current diverter circuit comprises transistors Q6 and Q7, resistor R6, and diodes D5, D6, and D7. The current control and light spreading module 130 further includes a current limiting and bias control resistor R9. The current diverter circuits include respective transistors (e.g., transistors Q6, Q8, and Q10) that are configured to provide respective controllable current diversion paths. These transistors may be turned on and off by bias transitions of the LED sets, which may be used to effect biasing of the transistors. Such circuitry may be relatively simple in comparison to circuitry that uses comparators or the like to control activation of LED sets in a string. In addition, the current diverter circuits may allow the LED sets LED1, LED2, and LED3 to be incrementally and cumulatively activated and deactivated. Operations of the current control and light spreading module 130 for managing operation of the LED string 140 is described in detail, for example, in the '127 application. It will be understood, however, that other techniques and circuits can be used to implement the current control and light spreading module 130 in accordance with various embodiments of the inventive subject matter. For example, the '076 appplication provides further embodiments of the current control and light spreading module 130 that can be used in the lighting apparatus of FIG. 12.

The notch circuit 122 comprises transistors Q4 and Q5, Zener diodes Dz2 and Dz3, resistor R5, and diode D4, which are configured as shown. The fill circuit comprises transistors Q1, Q2, optocoupler diode/transistor U1, resistors R1, R2, R3, and R4, Zener diode Dz1, and diode D3, which are configured as shown. Operations of the notch circuit 122 and fill circuit 124 according to some embodiments of the inventive subject matter will now be described.

The energy storage module 120 is operable to store energy when the rectified voltage Vrec exceeds the sum of the forward bias threshold voltages for the LED sets in the LED string 140 along with the breakdown voltages of the Zener diode Dz2 and Dz3, i.e., Vrec>V_LED1+V_LED2+V_LED3+V_Dz2+V_Dz3, then transistor Q4 is turned on, which allows capacitor C1 to charge. During this time interval, the LED string 140 is electrically disconnected from the rectified voltage Vrec because the breakdown voltage of the Zener diode Dz3 is greater than the sum of the forward bias voltages of the diodes D5, D6, and D7, i.e., V_Dz3>V_D5+V_D6+V_D7. As a result, transistor Q6 turns off to create an open circuit between the LED string 140 and resistor R9. The breakdown voltage of the Zener diode Dz3 along with resistor R9 can be used to limit the current during charging of the capacitor C1. The particular values chosen for the Zener diode Dz3 along with the resistor R9 may also be adjusted to control the width of the notch and fill pulse.

The energy storage module 120 is operable to apply the energy stored in the capacitor C1 to the LED string 140, i.e., LED sets LED1, LED2, and LED3 when the rectified voltage falls below the breakdown voltage of Zener diode Dz1, i.e., Vrec<Vdz1. Responsive to Vrec falling below Vdz1, transistor Q1 turns off and transistor Q2 turns on. This allows current to flow through the diode of the optocoupler U1, which turns the transistor of U1 on. The capacitor C1 then discharges into the LED string 140 to provide output during a valley portion of the rectified voltage Vrec. The diodes D2, D3, and D4 are configured to ensure desired current flow during the charging and discharging of the capacitor C1.

It will be understood that the present inventive subject matter is not limited to the embodiments of the notch circuit 122 and fill circuit 124 shown in FIG. 12. For example, a comparator circuit may be used in place of the Zener diodes Dz2 and Dz3 and transistor Q5 in the notch circuit 122 to compare the rectified voltage Vrec with a reference voltage and generate a bias voltage therefrom to turn off transistor Q6 to begin charging the capacitor C1. Similarly, a comparator circuit may be used in place of transistors Q1 along with resistors R1, R2, and R4 to compare the rectified voltage Vrec with a reference voltage to generate a bias voltage therefrom to turn transistor Q2 on or, if transistor Q2 is eliminated, operate a switch to allow current to flow through the optcoupler U1. Through use of respective comparator circuits in the notch circuit 122 and fill circuit 124, reference voltages can be adjusted to control the storage and discharge of energy in the storage element 126, e.g, capacitor C1.

A lighting apparatus based on the exemplary circuit embodiments of FIG. 12 may provide an efficacy of about 70 lumens per watt in a CR4 lighting unit with a correlated color temperature of about 6000K.

Embodiments have been described herein where a notch is formed in the LED string current generally centered around a peak in a rectified power voltage. A pulse is then generated that is generally centered around a valley in the rectified voltage. It will be understood that multiple notches and pulses may be generated that may further improve performance. For example, two notches may be formed in the LED string current that are timed so as to be generally symmetrical on either side of the peak portion of a rectified power voltage.

It will be further understood that the examples described herein in which a 50 Hz power voltage is used that is rectified to 100 Hz are for purposes of illustration only and the inventive subject matter is not limited to any particular frequency range. For example, power signals of other frequencies can also be used, such as a 60 Hz power voltage that is rectified to 120 Hz. Non-standard, low frequency power signals, such as a 20 Hz power voltage, may also be used. The embodiments of the inventive subject matter described herein are based on a sinusoidal based waveform for the non-rectified and rectified power voltage. Other waveforms can also be used, such as trapezoidal, triangular, etc., including non-symmetric waveforms.

Lighting apparatus circuits as described herein may be implemented in a number of different ways in accordance with various embodiments of the inventive subject matter. For example, rectifier circuitry, energy storage circuitry, light spreading circuitry, and LEDs as illustrated, for example, in the embodiments of FIGS. 1 and 12, may be integrated in a common unit configured to be coupled to an ac power source. Such an integrated unit may take the form, for example, of a lighting fixture, a screw-in or plug in replacement for a conventional incandescent or compact fluorescent lamp, an integrated circuit or module configured to be used in a lighting fixture or lamp or a variety of other form factors. In some embodiments, portions of the energy storage and/or light spreading circuitry may be integrated with the LEDs using composite semiconductor structures, e.g., the current diversion transistors Q6, Q8, and Q10 illustrated in FIG. 12 may integrated with the respective LEDs that they control to provide multi-terminal controllable LED devices configured for use in arrangements along the lines illustrated herein.

Figure 13:
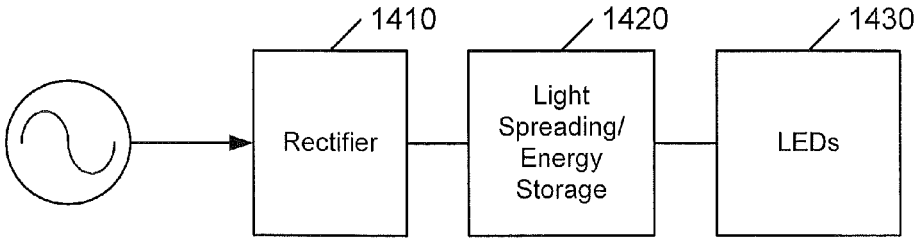
FIGS. 13-16 illustrate various arrangements of lighting apparatus components according to some embodiments of the inventive subject matter.
Figure 14:
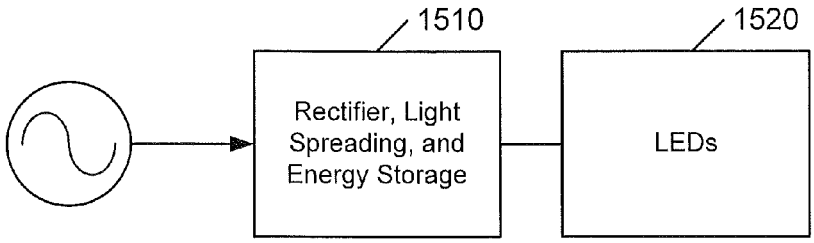
Figure 15:
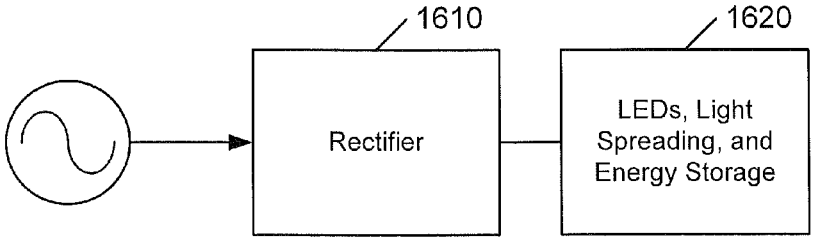
Figure 16:
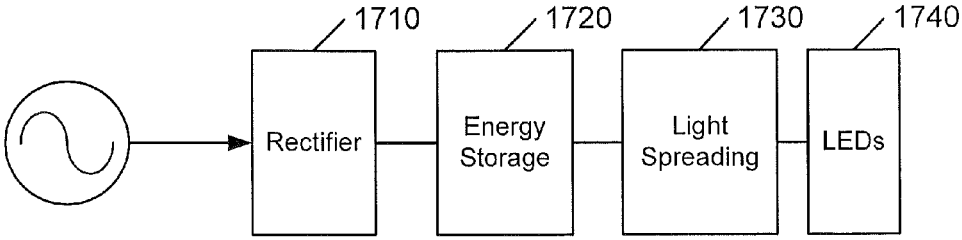

In some embodiments, such as shown in FIG. 13, a rectifier circuit, light spreading/energy storage circuitry, and LEDs may be implemented as separate units 1410, 1420, 1430 configured to be connected to an ac power source and interconnected, for example, by wiring, connectors and/or printed circuit conductors. In further embodiments, as shown in FIG. 14, a rectifier, light spreading circuitry and energy storage circuitry may be integrated in a common unit 1510, e.g., in a common microelectronic substrate, thick film assembly, circuit card, module or the like, configured to be connected to an ac power source and to LEDs 1520. As shown in FIG. 15, LEDs, light spreading circuitry, and energy storage circuitry may be similarly integrated in a common unit 1620 that is configured to be coupled to a rectifier unit 1610. In still other embodiments, a rectifier unit, energy storage circuitry, light spreading circuitry, and LEDs may be implemented as separate units 1710, 1720, 1730, and 1740 as shown in FIG. 16.

In the drawings and specification, there have been disclosed typical embodiments of the inventive subject matter and, although specific terms are employed, they are used in a generic and descriptive sense only and not for purposes of limitation, the scope of the inventive subject matter being set forth in the following claims.

That which is claimed:

1. A lighting apparatus, comprising:

a string of Light Emitting Diode (LED) sets coupled in series, each set comprising at least one LED;

a light spreading circuit configured to incrementally turn on respective ones of the LED sets responsive to a power signal; and an energy storage module that is configured to store energy during a first interval of a period of the power signal and to apply the stored energy to the string during a second interval of the period of the power signal.

2. The lighting apparatus of claim 1, wherein the energy storage module is further configured to divert current from the string to a charge storage element during the first interval.

3. The lighting apparatus of claim 2, wherein the energy storage module comprises a notch circuit that is coupled to a node of the string and is configured to electrically disconnect the string from the power signal responsive to a voltage of the power signal exceeding a threshold.

4. The lighting apparatus of claim 3, wherein the threshold is a summation of forward bias voltages of the respective LED sets and breakdown voltages of a pair of control Zener diodes.

5. The lighting apparatus of claim 2, wherein the energy storage module comprises a fill circuit that is configured to electrically couple the charge storage element to the string responsive to a voltage of the power signal falling below a threshold.

6. The lighting apparatus of claim 5, wherein the threshold is a breakdown voltage of a control Zener diode.

7. The lighting apparatus of claim 1, wherein the power signal has a peak voltage value during the first interval.

8. The lighting apparatus of claim 1, wherein the power signal has its lowest voltage value during the second interval.

9. The lighting apparatus of claim 1, wherein a voltage value of the power signal is greater during the first interval than the voltage value of the power signal during the second interval.

10. The lighting apparatus of claim 1, wherein the first interval and the second interval have approximately a same duration.

11. The lighting apparatus of claim 1, wherein all of the LED sets in the string are turned on during the second interval.

12. The lighting apparatus of claim 1, wherein a current signal through the string has a dominant frequency component that has a higher frequency value than a frequency value of a dominant frequency of the power signal.

13. The lighting apparatus of claim 12, wherein the frequency value of the dominant frequency component of the current signal through the string is at least three times the frequency value of the dominant frequency of the power signal.

14. The lighting apparatus of claim 1, further comprising a rectifier circuit configured to be coupled to an alternating current (ac) power source to generate the power signal.

15. A lighting apparatus, comprising:

a light source element; and an energy storage module that is configured to electrically disconnect the light source element from a power signal during a first interval of a period of the power signal to store energy and to apply the stored energy to the light source element during a second interval of the period of the power signal.

16. The lighting apparatus of claim 15, wherein the power signal has a peak voltage value during the first interval.

17. The lighting apparatus of claim 15, wherein the power signal has its lowest voltage value during the second interval.

18. The lighting apparatus of claim 15, wherein a voltage value of the power signal is greater during the first interval than the voltage value of the power signal during the second interval.

19. The lighting apparatus of claim 15, wherein the first interval and the second interval have approximately a same duration.

20. The lighting apparatus of claim 15, wherein a current signal through the light source element has a dominant frequency component that has a higher frequency value than a frequency value of a dominant frequency of the power signal.

21. The lighting apparatus of claim 20, wherein the frequency value of the dominant frequency component of the current signal through the light source element is at least three times the frequency value of the dominant frequency of the power signal.

22. The lighting apparatus of claim 15, further comprising a rectifier circuit configured to be coupled to an alternating current (ac) power source to generate the power signal.

23. The lighting apparatus of claim 15, wherein the light source element comprises a Light Emitting Diode (LED).

24. The lighting apparatus of claim 15, wherein the light source element comprises a string of Light Emitting Diode (LED) sets coupled in series, each set comprising at least one LED.

25. A method of operating a lighting apparatus, comprising:

electrically disconnecting a light source element from a power signal during a first interval of a period of the power signal to store energy; and applying the stored energy to the light source element during a second interval of the period of the power signal.

26. The method of claim 25, wherein the power signal has a peak voltage value during the first interval.

27. The method of claim 25, wherein the power signal has its lowest voltage value during the second interval.

28. The method of claim 25, wherein a current signal through the light source element has a dominant frequency component that has a higher frequency value than a frequency value of a dominant frequency of the power signal.

29. The method of claim 28, wherein the frequency value of the dominant frequency component of the current signal through the light source element is at least three times the frequency value of the dominant frequency of the power signal.

30. The method of claim 25, wherein the light source element comprises a Light Emitting Diode (LED).

31. The method of claim 25, wherein the light source element comprises a string of Light Emitting Diode (LED) sets coupled in series, each set comprising at least one LED.

* * * * *